United States Patent [19]

Vachet et al.

[11] 4,429,509

[45] Feb. 7, 1984

[54] MULTIPLE GLASS PANE WITH IMPROVED JOINTS OF PLASTIC MATERIALS

[75] Inventors: Joël Vachet, St. Germain du Plain; Justin Bruandet, Chalon sur Saone; Jacques Fremeaux, Bougival, all of France

[73] Assignee: Saint-Gobain Vitrage, Courbevoie, France

[21] Appl. No.: 355,480

[22] Filed: Mar. 8, 1982

[30] Foreign Application Priority Data

Mar. 10, 1981 [FR] France ..... 81 04706

[51] Int. Cl.[3] ..... E06B 3/24

[52] U.S. Cl. ..... 52/788; 52/398; 52/309.4; 156/107

[58] Field of Search ..... 52/172, 309.4, 398, 52/309.7, 309.5, 400, 788; 428/34; 156/107, 109

[56] References Cited

U.S. PATENT DOCUMENTS

| | | | |
|---|---|---|---|
| 3,733,237 | 5/1973 | Wolff | 52/172 X |
| 3,832,254 | 8/1974 | Bowser et al. | 52/172 X |
| 4,157,640 | 6/1979 | Joannes | 52/309.7 |
| 4,193,236 | 3/1980 | Mazzoni et al. | 52/398 X |
| 4,198,254 | 4/1980 | Laroche et al. | 156/107 |
| 4,299,639 | 11/1981 | Bayer | 156/107 |

FOREIGN PATENT DOCUMENTS

| | | | |
|---|---|---|---|
| 719064 | 10/1965 | Canada | 52/309.4 |
| 583837 | 10/1958 | Italy | 428/34 |

*Primary Examiner*—J. Karl Bell

*Attorney, Agent, or Firm*—Pennie & Edmonds

[57] ABSTRACT

The present invention relates to a multiple glass pane with joints of plastic materials.

It proposes, in order to reduce the cost of manufacturing such panes, to let the plastic material of the exterior joint polymerize by itself at the ambient temperature while the panes are piled in stacks, by incorporating in the joints spacer pieces such as staples, thumbtacks or coil springs which are able to maintain the distance between the glass sheets until polymerization occurs, but do not interfere with the normal function of the joints after polymerization has occurred.

The invention makes it possible to prevent any changes in the good appearance of the joints, and in their properties with regard to tightness and elasticity.

17 Claims, 9 Drawing Figures

Figure 3A:
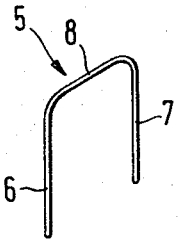

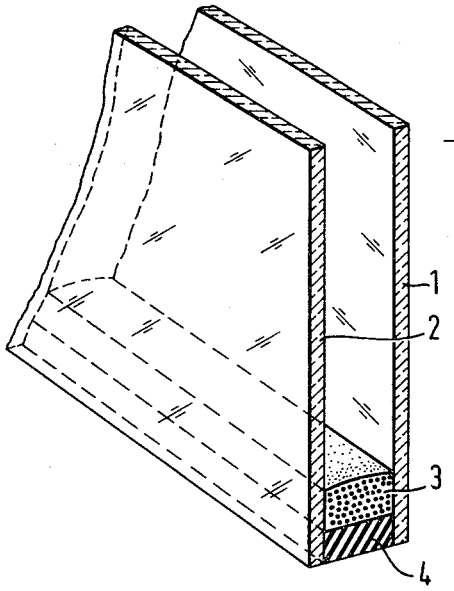
Fig. 1
Fig. 2
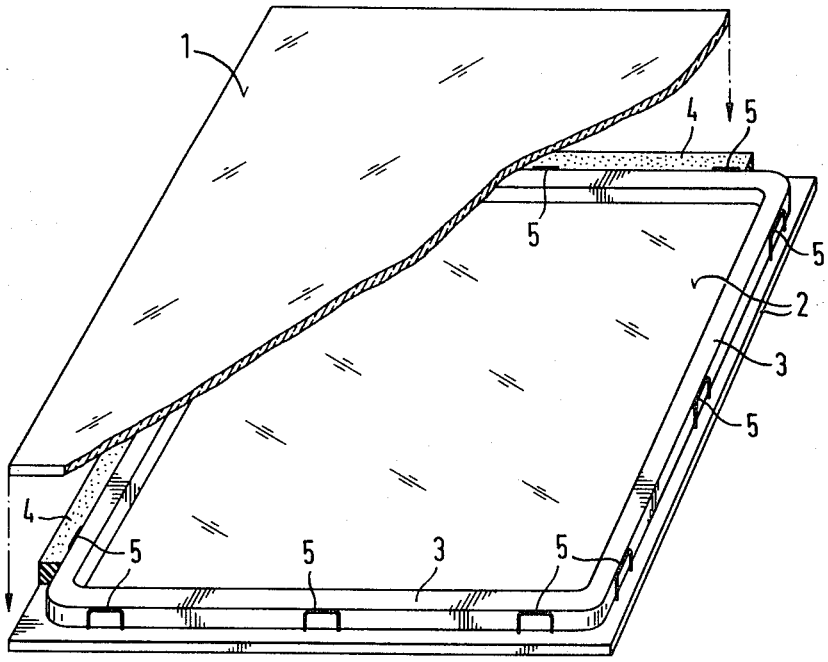

MULTIPLE GLASS PANE WITH IMPROVED JOINTS OF PLASTIC MATERIALS

The present invention relates to a multiple glass pane with joints of plastic materials.

Such multiple glass panes with joints of plastic materials are known from French patent Nos. 1,439,844, 1,527,165, 2,211,413, 2,287,278, 2,288,069, 2,294,314, 2,294,313, 2,294,140, 2,317,465. They consist of several glass sheets, placed in parallel with each other, separated from each other by a peripheral spacer ribbon of plastic material and held together by an exterior assembly joint, also of plastic material. The spacer ribbon may consist of a mixture of butyl rubber and polyisobutylene and the assembly joint may consist of polysulfide. In order to manufacture such multiple glass panes, for example double panes, the following procedure is used: The spacer ribbon is placed on the entire periphery of a first glass sheet, the two ends of the ribbon are joined in order to make said spacer ribbon continuous, a second glass sheet is placed on this ribbon parallel to the first sheet, the assembly is pressed lightly, the assembly joint cement is injected outside of the spacer ribbon along the entire periphery between the edges of the glass sheets, which are thus separated, and the glass pane obtained in this manner is placed into a furnace where it remains until the assembly joint is polymerized. The multiple glass pane is finished when it leaves the furnace.

The glass panes obtained in this manner are of good quality, the spacer ribbon and the exterior joint are well glued to each other on one hand and to the glass sheets on the other hand, and they supplement each other to ensure perfect tightness of the enclosed layer of air and high compression strength, property which are well maintained during aging.

These joints of plastic materials also impart to the glass panes a flexibility and elasticity which give said glass panes the ability to withstand large stresses even if they are evenly distributed, as well as vibration and distortion, for example that due to expansion.

But the manufacture of such glass panes is expensive. To begin with, the furnace for polymerization of the polysulfide requires a large investment, it consumes energy, and a certain number of panes breaks in said furnace. Furthermore, the polysulfide used must be of the type which is rapidly polymerized, in order to reduce the dwelling time in the furnace and to give the glass panes sufficient compression strength when they leave the furnace to permit stacking in piles. This polysulfide for rapid polymerization is also expensive.

In order to reduce the manufacturing costs, the polymerization furnace can be eliminated and a polysulfide with non-accelerated polymerization time can be used, if spacer pieces are placed in the glass panes, at least during the polymerization period, which keep the glass sheets separated until the polysulfide is polymerized and thus able to play its role. For this purpose spacer pads of rigid material could be placed as support at the edge of the produced glass panes whose polysulfide has not yet polymerized, and only during the polymerization period, which comprise, bent out of their principal pane which is pressed against the edge of the glass panes, fingers with a thickness equal to the space between the glass sheets, which are inserted between said glass sheets. But such spacer pads require two operations: placing and removal.

It is also possible, as described in U.S. Pat. No. 3,940,898, to incorporate in the glass panes rigid spacer pieces, which consist of a cylindrical head with a diameter equal to the distance between the glass sheets and a thinner part which is anchored in the cement of the joints. These spacer pieces effectively ensure the spacing of the glass sheets during the time required for the polymerization of the cement of the joint, but they do stay in place after polymerization is completed and represent a disadvantage. On one hand they are visible and impair the appearance, and on the other hand they make the glass pane completely inflexible.

In order to preserve the flexibility of the glass pane which is given to it by joints of plastic materials, it would be possible as described in U.S. Pat. No. 2,275,812 to use rubber blocks as spacer pieces which are embedded in the cement of the joints. But these rubber blocks are comparatively large so that they cause protrusions of the joints toward the interior of the glass panes, which impair the appearance, and also air bubbles in the cement itself which interfere with the good adherence of the cements to each other and to the glass sheets.

It is the purpose of the present invention to reduce the cost of manufacture of multiple glass panes with joints of plastic materials, and especially of glass panes comprising a polysulfide joint, by eliminating in the manufacturing sequence of said panes the polymerization furnace by using a polysulfide, and in general plastic materials, which polymerize at ambient temperature at a non-accelerated speed, and therefore are less costly, and by introducing in said glass panes at the moment when they are manufactured, spacer pieces of moderate cost which preserve the properties of glass panes with joints of plastic materials and whose purpose it is to maintain the spacing between the glass sheets as long as polymerization has not taken place.

For this purpose it proposes to introduce into the joints of plastic materials, in the upright position, a small number of spacer pieces, practically without thickness and of a height equal to the spacing between the glass sheets, of small length compared to the dimensions of the glass pane and presenting a resistance to crushing which is sufficient to maintain the spacing between the sheets of glass while the joint or joints are not yet polymerized, but which nevertheless can be deformed by large pressures.

Each spacer piece is in contact with each glass sheet of the glass pane at a small number of points, and preferably at only one or two points, so that the flexibility of the glass pane and its capacity to withstand vibration and deformation are preserved.

In a first type of embodiment these spacer pieces are staples embedded in the plastic materials of the legs in such a manner that the joints of said staples are perpendicular to the plane of the glass sheets.

Preferably a spacer ribbon is provided in this case which comprises on the outside a strip into which the staples are inserted; they thus stay well in place while awaiting the placement of the second sheet of glass and the injection of the assembly cement. These staples can be put in place by means of an automatic stapling gun which is placed directly after the equipment which places the spacer ribbon on the first glass sheet, with said stapling gun being advantageously controlled by a logic circuit.

In a second type of embodiment, these spacer pieces are thumbtacks with a crown-shaped head and preferably several points. These thumbtacks are inserted laterally into the joints and advantageously positioned flush against and between the two joints.

In another type of embodiment these spacer pieces are coil springs with their axes parallel to the glass sheets.

These spacer pieces are used in small numbers, they require little space, have practically no thickness and have limited crushing strength, so that they do not affect the characteristics of the finished glass panes, in particular the characteristics pertaining to flexibility, tightness and appearance.

Advantageously, each spacer piece shall have a sufficiently low crushing strength so that it is deformed by a small weight, not exceeding 3 kg.

Figure 3B:
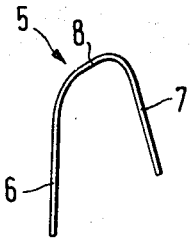
Figure 8:
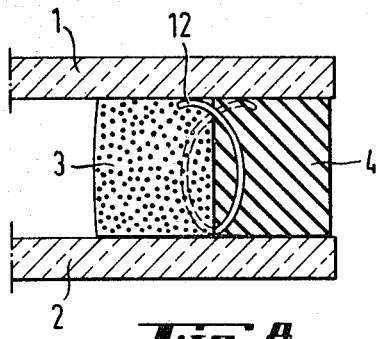
Figure 4:
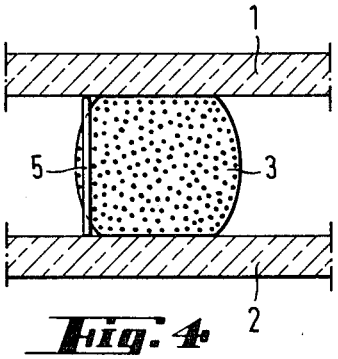
Figure 5:
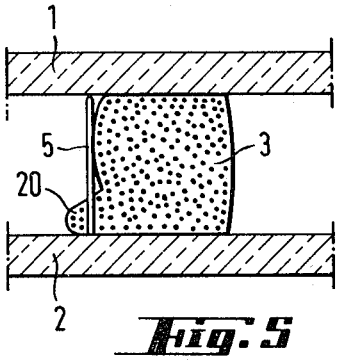
Figure 6:
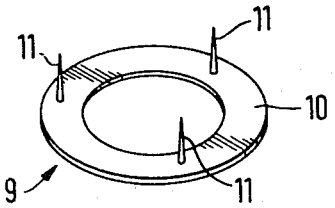
Figure 7:
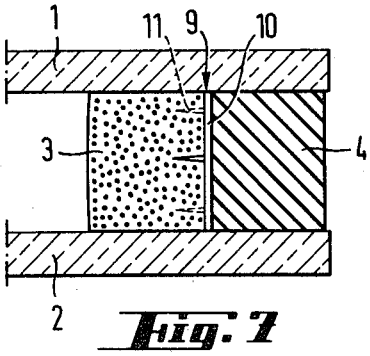

The invention will now be described in greater detail, with reference to the figures which show:

FIG. 1: a cross section of a glass pane with two joints of plastic materials,

FIG. 2: a schematic exploded view in perspective of a part of a double glass pane comprising staples, FIGS. 3A and 3B: two types of staples that can be used, FIG. 4: a schematic drawing showing the placement of the staples in the lateral bulge of the spacer ribbon, FIG. 5: a schematic drawing showing the modified cross section of the spacer ribbon and the position of the staples, FIG. 6: a thumbtack that can be used as spacer piece, FIG. 7: a schematic drawing showing the position of a thumbtack at the interface of the two joints, FIG. 8: a spring which is placed between two glass sheets and can serve as spacer piece.

FIG. 1 shows in cross section a double glass pane with joints of plastic materials for which the invention is particularly suited. This pane consists of two glass sheets 1 and 2, held in an assembled position at a given distance from each other by peripheral joints, i.e. a spacer ribbon 3 and an exterior joint 4.

In the embodiment shown in FIG. 2, the spacer pieces are U-shaped staples 5 whose legs are equal in height to the distance between the glass sheets of the multiple glass pane. These staples 5 are placed upright between the two glass sheets, preferably parallel to their sides and at the interface of spacer ribbon 3 and exterior joint 4, so that they are invisible, are protected by the joints against corrosion and do not change the shape, properties and functions of said joints.

For example, these staples could have one of the shapes shown in FIGS. 3A and 3B, i.e. be generally U-shaped with two legs 6 and 7, and a back 8 connecting them which preferably is of short length or even better of round shape so that it has only a few, or even only one point of contact with the glass sheets. The flexibility of the glass pane and the capacity of the glass sheets to move in relation to each other are thus preserved, so that the pane can withstand vibration, unevenly distributed stresses and deformation which may, for example, be caused by expansion due to exposure to the sun, without breaking of the glass sheets or unglueing of the joints. The crushing strength of these staples shall be sufficient to keep glass sheets 1 and 2 at a distance, even if they are stacked in a pile, while waiting for polymerization of the exterior joint 4.

This strength may be relatively low in view of the fact that during the short time when joint 4 does not play any role in keeping glass sheets 1 and 2 in place, spacer ribbon 3 is in its permanent shape and thus offers a certain resistance to crushing. The staples 5 are therefore used as a support only during the short period following manufacture. Each staple 5 should therefore be subject to deformation if exposed to a load of the order of magnitude of one kg, which, however, should not exceed 3 kg.

When joint 4 is polymerized and able to play its role and the staples 5 are no longer useful, they nevertheless do not represent an inconvenience, as care will have been taken to use only a small number, as they take up little space and therefore do not change the shape and appearance of joints 3 and 4 and do not cause any air bubbles which may cause unglueing of said joints, because they have practically no thickness and therefore can take on an inclined position between the two joints 3 and 4 if necessary, instead of rubbing against the glass sheets which the spacer pieces of the prior art could have done, and finally because they can be deformed, if necessary, by bending their legs 6 and 7 or by flattening their back 8 if it is rounded, so that joints 3 and 4 can play their role without hindrance.

At least one staple 5 will therefore be inserted on each side of the glass pane, but because of their low cost, and the fact that they do not disturb the joints, it would not do any harm to insert a few more, up to one staple every 15 cm. However, the number of staples per glass pane and the strength of each staple could be adapted to the type of manufacture of the panes and to the manner in which they are stacked. The essential point is that the glass panes, after they are manufactured and before joint 4 is polymerized, can be handled and stacked without crushing their internal space and that after polymerization of said joint the staples do not affect the "flexibility" of the glass panes, with the joints 3 and 4 then being sufficient by themselves to keep constant the thickness of this internal space.

The following method is used for manufacturing a double glass pane with staples 5 maintaining the spacing between glass sheets 1 and 2 during the polymerization of the cement of exterior joint 4.

First, the spacer ribbon 3 is placed along the entire periphery of the first glass sheet, for example sheet 1, then the staples 5 are inserted one by one, along ribbon 3 against the outside of that ribbon, then a second glass sheet, for example sheet 2, is placed on ribbon 3, parallel to the first sheet. Then pressure is applied and the cement of exterior joint 4 is injected between the edges of the two glass sheets outside of spacer ribbon 3. After injection of the cement of joint 4, the staples are safely held upright and they can play their role fully from that point on. As they are small, they do not change the properties of the joints, and as they are inserted after the spacer ribbon and before joint 4, during an operation which is completely separate from the extrusion of ribbon 3 and the injection of joint 4, they interfere neither with the extrusion nor with the injection operation. In order to better ensure that the staples remain upright before the cement of joint 4 is injected and prevent them from shifting during said injection operation, they can be inserted into the bulge of the outer edge of spacer ribbon 3 when they are applied, as shown in FIG. 4. If they are inserted in this manner, there is, however, the danger that ribbon 3 will be deformed and crushed at successive points, which may reduce the tightness of the glass panes. There is also the risk that, when pressure is applied to the pane before the injection of joint 4, the staples lie down, which would make them useless.

It is therefore preferable to slightly modify the shape of the cross section of spacer ribbon 3 and to add to it along its entire length, as shown in FIG. 5, preferably on the side which faces the outside of the glass pane and is extended to be in contact with exterior joint 4, a slight protrusion or strip 20 in which the staples 5 are inserted.

In this manner the essential part of ribbon 3 which ensures tightness between the glass sheets is in no manner injured by the insertion of the staples 5 and, when pressure is applied, it can be deformed without changing the orientation of strip 20 and also that of the staples 5.

This specific shape of the cross section of spacer ribbon 3 is obtained by giving the appropriate shape to the nozzle of the extruder by which the ribbon is produced.

The staples can be inserted with a pneumatic stapler, preferably an automatic stapler, located after the machine extruding ribbon 3.

Advantageously, this stapler is fastened to the extruder head so that when both the glass pane and the extruder are lifted at the corners of the pane in order to facilitate the placing of the ribbon and the rotation of the glass pane (see French patent No. 2,294,140 mentioned above), the stapler is lifted also at the same time as the extruder and thus does not interfere with the movements of the glass pane.

Advantageously, the stapler is triggered by means of a logic circuit. A sensor sensing the presence of a glass pane is usually installed in a line for manufacturing multiple glass panes, just before the extruder (see French patent No. 2,294,140). Upon the arrival of a glass sheet this sensor starts the extruder, possibly with a certain delay which is adjustable with the aid of a time-delay relay for taking account of the distance between the sensor and the extruder nozzle and of the travelling speed of the glass sheets; it stops the extruder at the passage of the rear edge of the glass sheet, if necessary with a certain delay. This same sensor can in the same manner start the logic circuit which controls the stapler. Another time-delay relay is then placed between the sensor and the logic circuit for controlling the start of the stapling operation as a function of the position of the sensor and of the stapler and of the travelling speed of the glass sheets.

In another embodiment, a detector which is independent of that which controls the extrusion, can be specially provided for controlling the stapler. The logic circuit can be designed in such a manner that it triggers the stapler at periodic intervals, for example, every ½ second. This corresponds to a staple every 15 cm if the glass sheets travel at 30 cm/second.

The logic circuit stops the stapling operation when the glass panel is stopped while it is being rotated.

With the aid of the adjustment of either the time delay between the detector and the logic circuit, or of the distance between the sensor and the stapler, the location of the first staple on each side of the glass pane can be determined.

The logic circuit can also be programmed in such a manner that a staple is dispensed just before each corner of the glass pane, even if the distance or the time interval from the previous staple is less than the preset distance between staples.

In a different embodiment, shown in FIGS. 6 and 7, the spacer pieces are thumbtacks 9, with a circular head 10 which is hollow at the center so that it resembles a crown which is practically without thickness and has a diameter equal to the desired distance between glass sheets 1 and 2, and with points, such as 11, for example three in number, perpendicular to head 10 and with sufficient length to permit inserting them into the thickness of joints 3 or 4 but nevertheless less than the thickness of said joints 3 or 4. A length of 2 mm will thus be very suitable, when the thickness of joints 3 or 4 is of the order of 3 or 4 mm.

As shown in FIG. 7, these thumbtacks 9 are inserted sideways with their points into the thickness of spacer ribbon 3 and then covered by the cement of joint 4.

Thus inserted into ribbon 3, they will stay in place awaiting the placement of the second glass sheet, the injection of cement 4 and the polymerization of said cement.

Although it is more difficult to execute, it is also possible to insert with the points 11 turned toward the outside of the glass pane, and it is even possible to insert a simple head 10 of a thumbtack 9 without points. In this case said thumbtack 9 or simple head 10 must be heated before insertion so that it adheres to spacer ribbon 3.

These thumbtacks 9 have the same resistance to deformation as the staples 5 and if a load is applied to them they will mainly deform themselves into an oval shape.

They can be inserted at the same intervals as the staples 5. They can be inserted by hand or preferably with an automatic machine, which inserts them either with the points into the ribbon or places them sideways against the ribbon, a machine of the same type and controlled in the same manner as the automatic stapler.

In another type of embodiment, shown in FIG. 8, the spacer pieces are coil springs 12, placed into joints 3 and 4 with the axis 13 of the spring parallel to the plane of the glass sheets.

One or two turns of such a spring 12, heated, then placed sideways against spacer ribbon 3 and subsequently embedded in the cement of joint 4, play the same role as a staple 5 or a thumbtack 10.

The resistance to crushing of these coil springs in the direction perpendicular to axis 13 should be of the same order of magnitude as that of the staples or thumbtacks.

Thus provided with spacer pieces, the multiple glass panes with joints of plastic materials can be handled and stacked without damage and without change in their future properties and design dimensions, as soon as they are manufactured and before the polymerization of said plastic materials.

The spacer pieces can remain in the glass panes after polymerization of the plastic materials of the joints; though no longer useful, they will not change the properties of the glass panes.

The invention has been described by taking as an example a multiple glass pane with two joints of two different plastic materials, i.e. one material being a mixture of butyl rubber and polyisobutylene, and the other polysulfide, but it applies as well to glass panes with one single joint or more than two joints, regardless of the nature of the plastic material which constitutes each joint.

We have provided for placement of the spacer pieces in joint 3, i.e. the joint which has its permanent properties as soon as it is put in place.

But if we suppose that it is joint 4 which has these permanent properties and that it is joint 3 which requires a certain amount of time before it can play its role, it will be preferable to place the spacer pieces in the joint which has its permanent properties from the beginning, i.e. in joint 4.

We claim:

1. A multiple glass pane consisting of glass sheets held together at a certain distance from each other by joints of plastic materials, comprising spacer pieces of a height equal to the distance between the glass sheets, inserted between the glass sheets and embedded in the joints, characterized in that each spacer piece is a piece practically without thickness, of small length compared to the dimensions of the glass pane and deformable in the direction of its height by a load of not more than 3 kg.

2. Glass pane according to claim 1, characterized in that a spacer piece is deformable by a load of the order of magnitude of 1 kg.

3. Glass pane according to any one of the claims 1 or 2, characterized in that the plane of the spacer pieces is parallel to the edge of the glass pane near which they are placed.

4. Glass pane according to claim 1 characterized in that the spacer pieces have a small number of contact points with each glass sheet, preferably one or two.

5. Glass pane according to claim 1 characterized in that the number of joints is two, that a spacer ribbon is surrounded by an exterior joint and that each spacer is located at the interface of the two joints.

6. Glass pane according to claim 1 characterized in that the spacer pieces are U-shaped staples, inserted perpendicularly to the planes of the glass sheets.

7. Glass pane according to claim 6, characterized in that the number of joints is two, that a spacer ribbon is surrounded by an exterior joint, and that the staples are inserted into the bulge of the spacer ribbon.

8. Glass pane according to claim 6, characterized in that the number of joints is two, that a spacer ribbon is surrounded by an exterior joint, and that the staples are inserted into a strip running along the entire length of the spacer ribbon on the outside of the glass pane.

9. Glass pane according to claim 1 characterized in that the spacer pieces are thumbtacks with a circular, cross-shaped head.

10. Glass pane according to claim 9, characterized in that each thumbtack has points of a length less than the thickness of the joint into which it is laterally inserted.

11. Glass pane according to claim 1 characterized in that the spacer pieces are coil springs with one or two turns, placed with their axis parallel to the planes of the glass sheets.

12. Glass pane according to claim 1 characterized in that it comprises from one spacer piece per side to one spacer piece every 15 cm, on each side of the glass pane.

13. Device for manufacturing multiple glass panes, as defined in claim 1 comprising a conveyor on which the glass sheets are carried, an extruder which extrudes the spacer ribbon and whose operation is triggered by a cell sensing the presence of a glass sheet under the extruder, characterized in that it comprises in addition a stapler, or a machine of the same type which is suitable for the type of spacer pieces, is located after the extruder, is controlled by a logic circuit which is actuated by a cell sensing the presence of a glass sheet under the stapler or machine of the same type, with said logic circuit being programmed to dispense the staples or spacer pieces at set time intervals.

14. Device according to claim 13, characterized in that the logic circuit is programmed to trigger, in addition, the placing of a spacer piece at each corner of the glass pane, at the end of the straight part of the ribbon.

15. Method for manufacturing a double glass pane with joints of plastic materials in which a spacer ribbon of plastic material is placed on a first glass sheet near its edges, a second glass sheet is placed on the spacer ribbon, pressure is applied, an exterior joint is injected on the outside of the spacer ribbon between the edges of the glass sheets, characterized in that after the placing of the spacer ribbon and before placing the second glass sheet thereon, upright staples are placed, at intervals, along the said ribbon, which are inserted into a strip running along its entire periphery, or into the bulge of said ribbon.

16. Method for manufacturing a double glass pane with joints of plastic materials in which a spacer ribbon of plastic material is placed on the first glass sheet near its edges, a second glass sheet is placed on the spacer ribbon, pressure is applied, an exterior joint is injected on the outside of the spacer ribbon between the edges of the glass sheets, characterized in that after the spacer ribbon is placed and before placing the second glass sheet thereon, thumbtacks are inserted laterally into spacer ribbon at intervals along said ribbon.

17. Method for manufacturing a double glass pane with joints of plastic materials in which a spacer ribbon of plastic material is placed on a first glass sheet near its edges, a second glass sheet is placed on the spacer ribbon, pressure is applied, an exterior joint is injected on the outside of the spacer ribbon between the edges of the glass sheets, characterized in that after the spacer ribbon is placed and before placing the second glass sheet thereon, the spacer pieces which were heated before, are placed against spacer ribbon.

* * * * *